United States Patent [19]

Hauser et al.

[11] 3,941,585

[45] Mar. 2, 1976

[54] PROCESS FOR COOLING SLAG AND INHIBITING POLLUTANT FORMATION

[75] Inventors: Karl V. Hauser, Ann Arbor; Lewis A. Paulsen, Belleville, both of Mich.

[73] Assignee: Edward C. Levy Company, Detroit, Mich.

[22] Filed: Feb. 19, 1971

[21] Appl. No.: 117,057

[52] U.S. Cl. ..... 75/24; 65/20

[51] Int. Cl.[2] ..... C21B 3/08

[58] Field of Search ..... 75/24, 30, 60, 97, 6, 108, 75/56; 106/51, 117; 23/181, 225; 65/19, 20

[56] References Cited

UNITED STATES PATENTS

| | | | |
|---|---|---|---|
| 133,466 | 11/1872 | Luckenbach | 65/19 |
| 443,898 | 12/1890 | Colquhoun | 75/24 |
| 1,414,491 | 5/1922 | Welch | 75/24 |
| 1,415,183 | 5/1922 | Lund | 75/24 |
| 1,916,954 | 7/1933 | Krause | 65/20 |
| 2,149,688 | 3/1939 | Schott | 65/20 |
| 2,471,562 | 5/1949 | Fitterer | 75/24 |
| 2,990,267 | 6/1961 | Grebe | 75/30 |
| 3,249,402 | 5/1966 | Smyers | 75/30 |
| 3,351,556 | 11/1967 | Tsourmas | 75/97 |

FOREIGN PATENTS OR APPLICATIONS

| | | | |
|---|---|---|---|
| 2,405 | 11/1908 | United Kingdom | 75/30 |
| 143,500 | 4/1921 | United Kingdom | 65/20 |

OTHER PUBLICATIONS

Treadwell & Hall, Analytical Chemistry, Vol. I, p. 353, (1937).

*Primary Examiner*—M. J. Andrews

*Attorney, Agent, or Firm*—Harness, Dickey & Pierce

[57] ABSTRACT

A process for cooling sulfur-bearing slag while inhibiting the formation of hydrogen sulfide. An oxidant is mixed with the cooling water and the slag is brought into contact therewith, the solution cooling the slag to permit handling thereof while the oxidant inhibits the release of hydrogen sulfide.

20 Claims, No Drawings

PROCESS FOR COOLING SLAG AND INHIBITING POLLUTANT FORMATION

BACKGROUND OF THE INVENTION

1. Field of the Invention

The cooling of sulfur-bearing slag such as blast furnace slag is conventionally accomplished by the use of water, for example by pouring it onto the slag in pits, by pouring molten slag into a reservoir of water, or dampening the ground on which thin layers of molten slag are poured. The slag is cooled by the water in order to permit its handling within a reasonable time after pouring. However, this cooling has heretofore been accompanied by the release of hydrogen sulfide which is malodorous, noxious and therefore considered an undesirable air pollutant. In fact, recently enacted anti-pollution codes in some localities prohibit the water quenching of slag except under conditions which prevent the discharge of all hydrogen sulfide or other air contaminants into the open air.

2. Description of the Prior Art

No process is presently known which inhibits the formation of objectionable hydrogen sulfide during the water cooling of hot sulfur-bearing slag. The Battelle Memorial Institute, Columbus, Ohio, in a 1968 paper by F. H. Woehlbier and G. W. P. Rengstorff entitled "Preliminary Study of Gas Formation During Blast-Furnace Slag Granulation with Water," discusses the possible reasons for the creation of hydrogen sulfide and suggests two approaches for suppressing its formation. One is to add oxidants to the slag prior to granulation, that is, while the slag is in its molten state. This suggestion is believed unfeasible because of the inability to stir an oxidant into molten slag while in a large ladle. The second suggestion is to conduct the granulation in such a manner as to destroy any possible protective gaseous layers which prevent combustion of the hydrogen sulfide, for example by a strongly agitated water bath or in a waterair jet. However, this process would create very fine, friable weak particles of insufficient strength or size to be used for example as an aggregate road base.

Knuppel U.S. Pat. No. 2,829,959 is a process for producing slag wool in which the slag is desulfurized by subjecting molten slag to an oxidizing treatment. Aside from being an entirely different process than that of the present invention, the Knuppel method would result in sulfur dioxide, an undesirable contaminant, being released into the atmosphere. Other U.S. patents such as Elbers U.S. Pat. No. 278,002, Wuth U.S. Pat. No. 643,856, Parsons U.S. Pat. No. 1,551,616, and Smyers U.S. Pat. No. 3,249,402 shows various methods for the removal or recovery of sulfur from blast furnace slag, but none of these are related to the present invention.

BRIEF SUMMARY OF THE INVENTION

According to the invention, a readily reactive water soluble oxidant such as sodium hypochlorite (NaOCl) is mixed with the cooling water, and the sulfur-bearing slag is brought into contact with this solution so as to cool it sufficiently for digging or other handling. It has been found that during this cooling operation the oxidant inhibits the release of hydrogen sulfide from the slag to a major degree satisfying anti-pollution requirements. There is also no release of other contaminants such as sulfur dioxide.

DESCRIPTION OF THE PREFERRED EMBODIMENTS

One manner of carrying out the process of this invention is in connection with air cooled slag, that is, slag which is poured while in its molten state into pits in the earth where it cools in air and solidifies. Normally, the great amount of heat in the mass of slag prevents it from cooling in air within a reasonable time to permit digging. The rate of cooling is therefore accelerated by the sprinkling or pouring of water onto the slag. As the outer slag layers are cooled, they crack, permitting the water to penetrate to the next layers which, when they crack upon cooling, will allow still deeper water penetration.

The hydrogen sulfide which is released into the air by this conventional cooling method is not only objectionable because of its repugnant odor, but is also highly noxious. Ten parts per million by volume of hydrogen sulfide will produce slight toxic symptoms, whereas 600 parts per million will kill most animals in a short time.

According to the invention, an oxidant is dissolved into the cooling water before it is brought into contact with the slag to be cooled. The oxidizing agent used must be soluble in water, should be substantially more readily reactive than the oxygen inherently entrained in the cooling water, and must have no harmful side or polluting effects. The oxidizing agent should also be economical, and its reaction products must not be a hazard to the slag product or the environment. Suitable oxidizing agents are an oxidizing metal hypochlorite such as sodium hypochlorite, chlorine, an oxidizing metal permanganate such as potassium permanganate, a peroxide type oxidizing material such as sodium peroxide or hydrogen peroxide, and fluorine. The strength of solution will depend upon various factors, such as the particular oxidant used, the economy and effectiveness desired, and the amount of sulfur in the slag. The more sulfur found, the more concentrated must be the solution. For use with blast furnace slag, approximately 200 to 400 parts per million by weight of sodium hypochlorite has been found suitable.

In use with air cooled slag poured into pits, the solution of oxidant in cooling water would be poured onto the slag through the conventional piping systems, such as swiveled nozzles or fixed piping networks. The oxidant could be metered into the cooling water as it flows toward the slag pit.

In using the process for light weight slag, which is conventionally poured in single layers onto slightly damp ground so that the water steams through the slag, the ground would be initially dampened by water to which the soluble oxidant has been added. The steaming water would thus carry the oxidant with it through the slag layer.

Another manner of carrying out the invention is in connection with the pouring of molten slag into a reservoir containing a large excess of water which rapidly cools and breaks up the slag. According to the invention, the soluble oxidant would be first added to the water in the reservoir and the molten slag then poured in. As the slag cools and breaks up, the oxidant will inhibit the release of hydrogen sulfide therefrom.

One advantage of the process of this invention is that it creates intimate exposure to oxidizing conditions at all areas of incipient hydrogen sulfide creation. The exact nature of the reactions which occur to inhibit the formation of hydrogen sulfide are uncertain. However, the aforementioned Battelle Memorial Institute report indicates that the amount of hydrogen sulfide formed by water quenching of slag is directly proportional to the amount of hydrogen formed. It is believed that the process of the present invention serves to neutralize this hydrogen by the following formula (assuming sodium hypochlorite as the oxidant):

$$NaOCl + H_2 \rightarrow Na\,Cl + H_2O.$$

Where hydrogen sulfide might have been formed, for example by the combination of calcium sulfide in the slag and water, it can be oxidized by the reaction:

$$NaOCl + H_2S \rightarrow Na\,Cl + H_2O + S.$$

What is claimed is:

1. A process for cooling sulfur-bearing blast furnace slag molten at an elevated temperature and simultaneously inhibiting the liberation of hydrogen sulfide, comprising the steps of mixing a water soluble oxidant with cooling water, said oxidant being a substantially more readily reactive oxidizing agent than the oxygen inherently entrained in said cooling water, the concentration of oxidant being sufficient to inhibit to a major degree the release of hydrogen sulfide from the slag, and bringing slag into contact with said solution of oxidant and water so as to cool the slag sufficiently for handling, said oxidant inhibiting the release of hydrogen sulfide from the slag.

2. The process according to claim 1, said oxidant being selected from the following group of oxidants: chlorine, sodium hypochlorite, potassium permanganate, sodium peroxide, hydrogen peroxide and fluorine.

3. The process according to claim 1, said oxidant being sodium hypochlorite.

4. The process according to claim 1, said oxidant being chlorine.

5. The process according to claim 1, said oxidant being selected from at least one material of the group consisting of an oxidizing metal hypochlorite, an oxidizing metal permanganate, a peroxide type oxidizing material, and fluorine.

6. The process according to claim 1, said oxidant being potassium permanganate.

7. A method for reducing the emission of hydrogen sulfide during the quenching of hot blast furnace slag comprising contacting the slag with a quench-anti-emission medium, where said medium is selected from an aqueous solution of chlorine gas and from an aqueous solution of sodium hypochlorite.

8. In a process for cooling sulfur-bearing blast furnace slag molten at an elevated temperature and simultaneously inhibiting the formation of hydrogen suslfide, the steps of pouring slag while molten into a cooling pit, mixing a water soluble oxidant with cooling water, said oxidant being a substantially more readily reactive oxidizing agent than the oxygen inherently entrained in said cooling water, the concentration of oxidant being sufficient to inhibit to a major degree the release of hydrogen sulfide from the slag, and pouring said solution of oxidant and water onto the hot slag.

9. The process according to claim 8, said oxidant being metered into the cooling water as it flows toward the slag pit.

10. In a process for cooling sulfur-bearing slag which is molten at an elevated temperature and simultaneously inhibiting the formation of hydrogen sulfide, the steps of mixing a readily reactive water soluble oxidant with water, the concentration of oxidant being sufficient to inhibit the release of hydrogen sulfide from the slag, pouring said water on the ground so as to dampen it slightly, and pouring a layer of molten slag onto the slightly damp ground, whereby the steam will penetrate the slag layer with the oxidant inhibiting the release of hydrogen sulfide therefrom.

11. The process according to claim 10, said oxidant being taken from the class consisting of sodium hypochlorite and chlorine.

12. In a process for cooling sulfur-bearing blast furnace slag molten at an elevated temperature by pouring the molten slag into a reservoir containing cooling water and simultaneously inhibiting the formation of hydrogen sulfide, the steps of first mixing a water soluble oxidant into the cooling water, said oxidant being a substantially more readily reactive oxidizing agent than the oxygen inherently entrained in said cooling water, the concentration of oxidant being sufficient to inhibit to a major degee the release of hydrogen sulfide from the slag, and then pouring the molten slag therein whereby the slag is cooled and broken up by the water while the oxidant inhibits the release of hydrogen sulfide.

13. The combination according to claim 12, said oxidant comprising chlorine.

14. The process according to claim 12, said oxidant comprising sodium hypochlorite.

15. The process according to claim 5, said oxidant being selected from at least one material of the group consisting of an oxidizing metal hypochlorite, an oxidizing metal permanganate, a peroxide type oxidizing material, and fluorine.

16. The process according to claim 5, said oxidant being potassium permanganate.

17. A process for reducing the emission of hydrogen sulfide during the quenching of hot blast furnace slag comprising contacting the slag with a quench-anti-emission medium, where said medium is selected from the following: an aqueous solution of chlorine, an aqueous solution of an oxidizing metal hypochlorite, an aqueous solution of an oxidizing metal permanganate, an aqueous solution of a peroxide type oxidizing material, and an aqueous solution of fluorine.

18. The process according to claim 17, said oxidant being selected from the following group of oxidants: chlorine, sodium hypochlorite, potassium permanganate, sodium peroxide, hydrogen peroxide and fluorine.

19. The process according to claim 18, said medium being an aqueous solution of potassium permanganate.

20. The process according to claim 18, said medium being an aqueous solution of sodium hypochlorite.

* * * * *

UNITED STATES PATENT AND TRADEMARK OFFICE

CERTIFICATE OF CORRECTION

PATENT NO. : 3,941,585

DATED : March 2, 1976

INVENTOR(S) : Karl V. Hauser et al

It is certified that error appears in the above-identified patent and that said Letters Patent are hereby corrected as shown below:

Column 3, line 15, "$H_2s$" should be --$H_2S$--. In the claims: Claim 8, column 3, line 56, "suslfide" should be --sulfide--; claim 15, column 4, line 38 and claim 16, column 4, line 43, "5" should be --12--.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*